US006082437A

United States Patent [19]

Damasse et al.

[11] Patent Number: 6,082,437

[45] Date of Patent: Jul. 4, 2000

[54] SIDE WALL FOR CLOSING OFF THE CASTING SPACE OF A PLANT FOR THE TWIN-ROLL CONTINUOUS CASTING OF THIN METAL STRIP

[75] Inventors: Jean-Michel Damasse, Isbergues; Dominique Themines, Hazebrouck; Paul-Victor Riboud, Metz; Christophe Ganser, Bethune, all of France

[73] Assignees: Usinor, Puteaux, France; Thyssen Stahl Aktiengesellschaft, Duisburg, Germany

[21] Appl. No.: 09/104,981

[22] Filed: Jun. 26, 1998

[30] Foreign Application Priority Data

Jul. 4, 1997 [FR] France ..... 97 08447

[51] Int. Cl.[7] ..... B22D 11/06

[52] U.S. Cl. ..... 164/428; 164/480

[58] Field of Search ..... 164/428, 480, 164/432, 481

[56] References Cited

U.S. PATENT DOCUMENTS

| | | | |
|---|---|---|---|
| 5,127,462 | 7/1992 | Moriwaki et al. | 164/432 |
| 5,247,987 | 9/1993 | Tavernier et al. | 164/480 X |

FOREIGN PATENT DOCUMENTS

| | | | |
|---|---|---|---|
| 0 403 412 | 12/1990 | European Pat. Off. . | |
| 0 432 073 | 6/1991 | European Pat. Off. . | |
| 0 477 045 | 3/1992 | European Pat. Off. . | |
| 0552125 | 7/1993 | European Pat. Off. | 164/428 |
| 60-148646 | 8/1985 | Japan | 164/480 |
| 60-162558 | 8/1985 | Japan | 164/480 |
| 63-5855 | 1/1988 | Japan | 164/432 |
| 64-2764 | 1/1989 | Japan | 164/432 |
| 64-34547 | 2/1989 | Japan | 164/428 |

OTHER PUBLICATIONS

Abstract of Japanese Patent Publication 62–212041 Published Sep. 18, 1987.

*Primary Examiner*—J. Reed Batten, Jr.
*Attorney, Agent, or Firm*—Nixon Peabody LLP; Thomas W. Cole

[57] ABSTRACT

A side wall is provided for closing off the casting space of a plant for the continuous casting of metal strip between two counterrotating rolls which define a nip area and have horizontal axes, of the type including an upper edge, a lower edge, and a face that defines part of a casting space. The wall includes a lower part for preventing cracking in the side wall adjacent to the nip area that includes a recess filled with a refractory. Preferably, the refractory enclosed by the recess is a material having a lower hardness than the refractory forming the balance of the wall, and high thermal insulation properties.

6 Claims, 2 Drawing Sheets

(art antérieur)

(art antérieur)

SIDE WALL FOR CLOSING OFF THE CASTING SPACE OF A PLANT FOR THE TWIN-ROLL CONTINUOUS CASTING OF THIN METAL STRIP

This is a division of application Ser. No. 08/965,725, filed Nov. 7, 1997, now U.S. Pat. No. 5,943,990.

BACKGROUND OF THE INVENTION

The invention relates to the continuous casting of metals, and more particularly to plants for casting metal strip, especially steel strip, a few mm in thickness, between two internally cooled counterrotating rolls having horizontal axes.

DESCRIPTION OF THE PRIOR ART

In these plants, in which the industrial application to steel casting is currently being studied, the casting space is bounded by the lateral surfaces of the rolls, against which solidification of the metal takes place, and by side closure plates made of refractory which are applied against the plane ends (called "end faces") of the rolls. Such a plant is described, for example, in document EP-A-0698433.

The side closure plates must, at least on their parts which rub against the end faces of the rolls, be made of a first refractory, such as SiAlON®, which has a high hardness and high resistance to corrosion by liquid metal. These conditions are deemed necessary in order to obtain satisfactory sealing of the rolls/side-plate contacts, and thus to prevent molten metal from escaping from the casting space at these contacts. That central part of the side wall which is only in contact with molten metal, and not with the rolls, may be made of a second refractory, for example a material based on alumina or silica. Above all, this second material must be a good thermal insulator, so as to prevent the liquid metal from solidifying when coming into contact with it. However, in the lowermost part of the side wall, which, in the case of the use of rolls having a diameter of 1500 mm, starts 5 to 10 centimeters above the "nip" (i.e. the point at which the rolls are closest together and below which the strip is completely solidified), it is assumed that the side wall must be made of said hard first refractory, or another material having equivalent properties. This is because this region is subjected to significant rubbing, not only caused by the rolls but also:

- by solidified metal present on the surfaces of the rolls (this being called the "solidified shells");
- by metal in the pasty state (i.e. partially solidified metal) which is present between the solidified shells just above the nip, close to the side walls, and which tends to be driven toward the nip due to the effect of the movement of the rolls; and
- beneath the nip, by the strip itself.

The surety of the contact between side walls and rolls in this region throughout the casting run must take precedence over the prevention of spurious solidification therein. Moreover, the very narrow width of the space separating the rolls in the nip area (equal to the desired thickness of the strip, i.e. a few mm) would make the juxtaposition of the various materials, as exists in the rest of the side wall, very difficult, or even impossible, at this point, During casting, the pressing action of the side walls against the end faces of the rolls causes frictional wear of the side walls, but only in the regions where they are in contact with the rolls. As a result, those parts of the side walls which are not subjected to this frictional wear gradually penetrate into the casting space, over a depth which may end up being as much as 5 to 15 mm. Thus, what is sometimes called a "positive insert" is formed.

When the worn side walls are examined after a casting run, it is very frequently observed that the lower part of the positive insert is fractured—a sign of the intense stresses to which it has been subjected during casting. This fracture has the effect of suddenly decreasing the depth of penetration of the positive insert into the casting space at a point lying several centimeters above the nip, or even of completely destroying the positive insert at this point. The fracture follows a random path, which may depend in particular on the internal soundness of the refractory. There is therefore a high risk of this fracture propagating in various directions within the refractory, causing the rupture and departure of portions of the side wall which face regions of the casting space where the metal is in the clearly liquid state. In this case, inevitably, leaks of liquid metal from the casting space are observed, which cause an at least momentary deterioration in the quality of the strip. If the fracture takes place in a rolls/side-wall contact region, the sealing of this contact may be reestablished by pressing more strongly on the side wall: its wear makes it possible to restore a contact surface which matches the geometry of the end faces. However, if the incident occurs too often during casting, this leads to an excessive consumption of the hard refractory of the side wall, there thus being a risk of the entire casting run not being supported if the side-wall thickness is too small. However, making this hard refractory sufficiently thick to ensure that it supports the entire casting run, even when many incidents of the type just described occur, would result in the side wall being excessively costly. Finally, if a particularly serious leak of liquid metal occurs, it may quite simply cause an emergency stoppage of the casting run and damage to the plant.

SUMMARY OF THE INVENTION

The object of the invention is to provide a configuration of the side wall which prevents the degradation of the positive insert from having deleterious consequences on the quality of the strip and the execution of the casting run.

For this purpose, the subject of the invention is a side wall for closing off the casting space of a plant for the continuous casting of metal strip between two counterrotating rolls which are close together and have horizontal axes, of the type including a lower part made of a high-hardness first refractory in the region where said lower part is in contact with the end faces of said rolls, or liquid metal likely to be in the course of solidifying, or an edge of the solidified strip, wherein said lower part includes, on its face intended to be turned toward the casting space, a recess filled with a refractory.

Preferably, said refractory enclosed by said recess is a material having a lower hardness than said first refractory and high thermal insulation properties.

As will have been understood, the invention consists in giving the side wall, in its lowest part, a two-layer structure designed so that when the stresses exerted on the upper layer by the solidified metal become high this upper layer degrades without it being possible for this degradation to be extended to upper levels of the side wall. Thus, there is the possibility of controlling the progress of a phenomenon which, if it were to be completely out of control, could lead to serious disruptions to the operation of the casting machine.

BRIEF DESCRIPTION OF THE DRAWINGS

The invention will be more clearly understood on reading the description which follows, given with reference to the following appended figures.

DESCRIPTION OF THE PREFERRED EMBODIMENTS

The dimensions which will be given by way of example for the various elements of the side walls according to the invention are valid in the case in which casting rolls having a diameter of about 1500 mm are used. If smaller rolls are used, these dimensions must be reduced accordingly.

Figure 1:
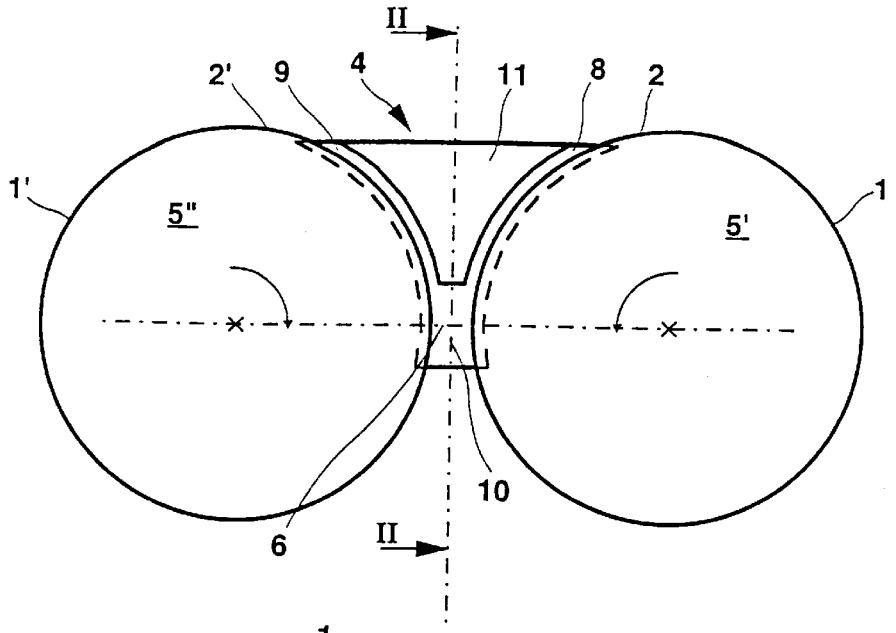
FIG. 1, which shows, diagrammatically, seen from the front and at rest, a plant for the twin-roll continuous casting of thin strip, which is provided with only one of its two side walls, these being according to the art prior to the invention.

The twin-roll casting plant according to the prior art, illustrated in FIGS. 1 and 2, conventionally comprises two rolls 1, 1' which are close together and have horizontal axes, the cylindrical lateral walls 2, 2' of which are intensely cooled on the inside. They are rotated in opposite directions by known means (not illustrated). The casting space, into which the liquid steel 3 is introduced via a nozzle (not illustrated) connected to a container such as a ladle or a tundish, is bounded by the lateral walls 2, 2' of the rolls 1, 1' and by side walls 4, 4' made of refractory (the side wall 4' is not illustrated in FIG. 1 in order to make the construction of the side wall 4 visible). They are applied by known means (not illustrated) against the end faces 5, 5', 5" of the rolls 1, 1' so as to close off the casting space laterally and thus prevent the liquid steel 3 from escaping therefrom. The document EP-A-0698433 already mentioned describes a (nonlimiting) example of such means in detail. The liquid steel 3 solidifies against the lateral walls 2, 2' of the rolls and forms thereon two "shells" which join up in the region of the nip 6 (the region where the lateral surfaces 2, 2' of the rolls 1, 1' are closest together) in order to form a steel strip 7 which is continuously extracted from the plant by known means (not illustrated).

Figure 2A:
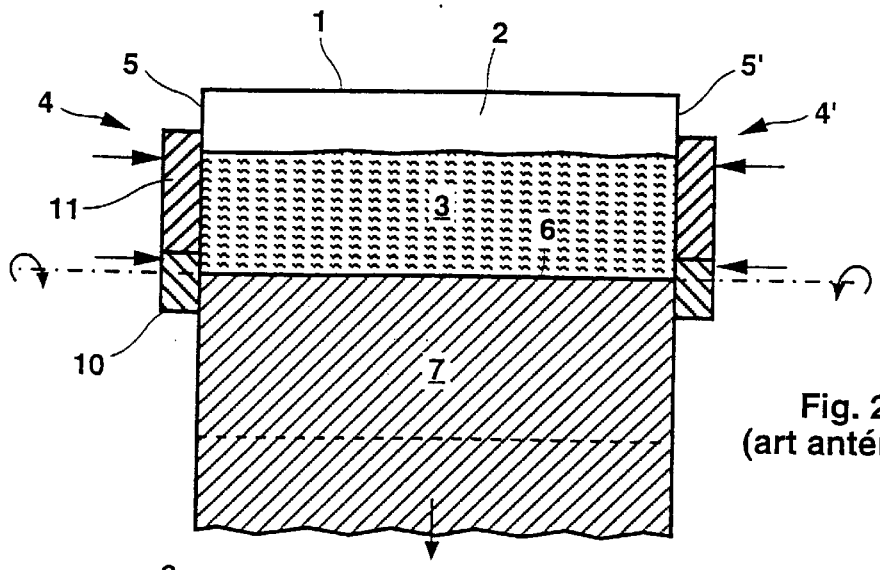
FIG. 2 which shows, seen from the side in longitudinal section on II—II, the same plant at the initial stage of the casting of a thin strip (FIG. 2*a*) and then at a stage in the casting run where the side walls have already undergone significant wear (FIG. 2*b*)
Figure 2B:
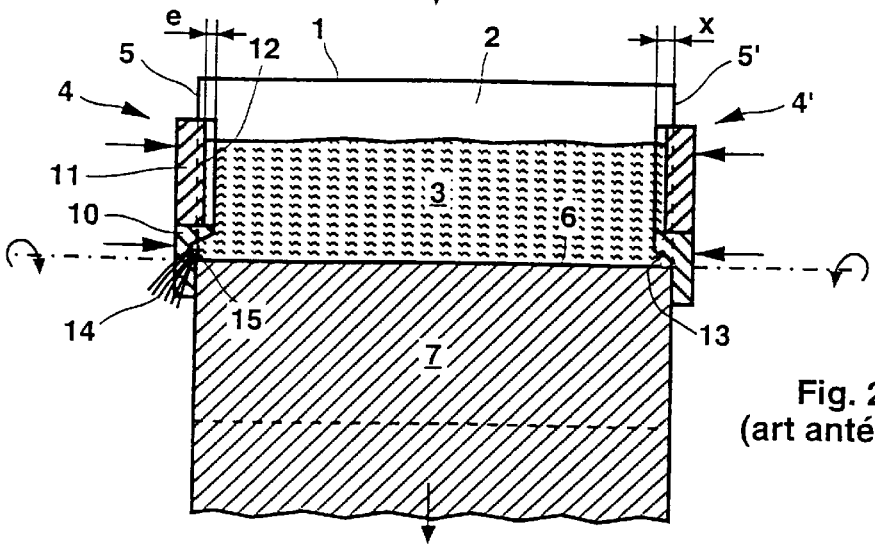
Figure 3A:
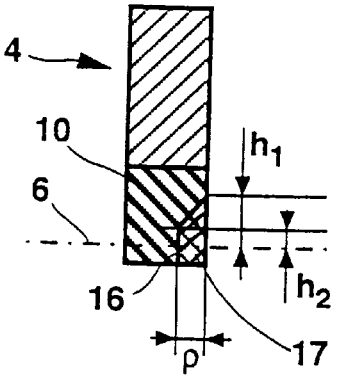
FIG. 3 which shows, diagrammatically, seen from the side in cross section on IIIa—IIIa (FIG. 3*a*) and in a front view (FIG. 3*b*), a side wall according to the invention.
Figure 3B:
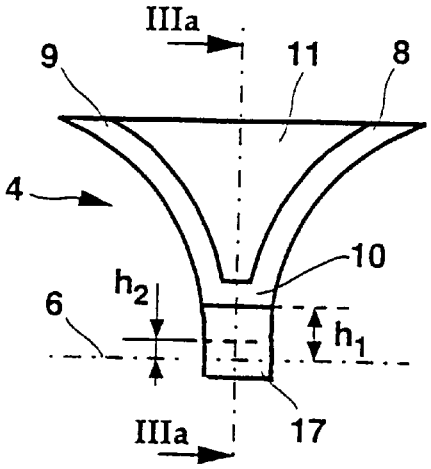

As may be seen from FIG. 1, the refractory elements of the side walls 4, 4' of the example illustrated have two parts. Their portions 8, 9 which are in contact with the end faces 5, 5' of the rolls 1, 1' or near the regions where this contact occurs, as well as their entire lower part 10 over a height of approximately 150 mm, are made of a first material, having a high hardness and good properties of resistance to corrosion by the liquid metal. The remaining, central part 11 of the side walls 4, 4' is made of a material preferably having good thermal insulation properties and possibly a lower hardness than said first material. FIG. 2*a* illustrates the plant at the start of the casting run, while the side walls 4, 4' are new and have, opposite the end faces 5, 5' of the rolls, the liquid steel 3 and the strip 7, a uniformly plane front face. FIG. 2*b* illustrates the same plant at a subsequent stage in the casting run, when the side walls 4, 4' have already undergone significant wear. The central part 11 has been consumed over a relatively large depth "e" by corrosion and mechanical wear in contact with the moving liquid steel 3. The portions 8, 9 and 10 made of hard material have suffered frictional wear over a depth "x" in their regions which are opposite the end faces 5, 5' of the rolls 1, 1', while their regions which have not suffered frictional wear by the end faces 5, 5' have, in the ideal case illustrated, not suffered any wear. During casting, the latter regions therefore form, with the refractory of the central part 11 that they surround, a "positive insert" 12 which penetrates into the casting space. In its lower part, this positive insert 12 is subjected on its front part to high stresses by the steel 3 which may already be, near it, in a partially solidified state. These side parts are likewise subjected to contact with the metal shells which have solidified against the rolls. Consequently, due to the effect of these various stresses, periodic and uncontrolled fracture of the lower part of the positive insert 12 occurs, along a generally irregular line 13. In some cases, this fracture extends relatively deeply into the refractory, to the point of destroying the sealing of the casting space and allowing the possibility of liquid steel 14 escaping from this space via an anfractuosity 15. This is particularly the case if the fracture propagates toward the top of the positive insert 12, and therefore toward the regions where the metal close to the side wall 4, 4' is entirely in the liquid state. If this metal 14 immediately solidifies between the side wall 4 and the end face 5, it causes the side wall 4 to retract and contributes a little more to its deterioration, as well as to that of the end face 5. If the anfractuosity 15 emerges to the outside, the liquid steel 14 may flow out of the casting machine with all the risks that this entails for the plant and the operators.

According to the invention, in order to avoid the problems caused by these uncontrolled fractures of the lower part of the positive insert 12, it is chosen to create, deliberately, by construction, in the lower part of the side wall 4, 4', a region where this fracture, if it occurs, will be confined. For this purpose, a recess 16 is made in the lower part of the side wall, 4, 4' over a height which extends from its lower edge up to, for example, approximately 70 mm above the level of the nip 6, this recess 16 being filled with a refractory 17. The latter may be the hard and corrosion-resistant refractory which forms the rest of the lower part 10 of the side wall 4, 4'. It may also be a material which is less resistant to abrasion by a solid metal or a metal in the course of solidifying, as well as to corrosion by the liquid metal, but one which does have good thermal insulation properties. For this purpose, the same material as the core 11 of the side wall 4, 4' may be chosen. However, a refractory having a lamellar structure, such as graphite or boron nitride, would also be well suited for this purpose, for reasons which will be explained later. The two refractories involved are fastened together using conventional methods, for example by bonding.

In the preferred embodiment of the invention which is illustrated, the depthwise longitudinal cross sections of the recess 16 and of the refractory 17 which fills it have the shape of a right-angled trapezium, the tip of which is oriented toward the upper part of the casting space and the large base of which lies opposite this same casting space. This large base extends over a height "$h_1$" above the nip 6, "$h_1$" being, for example, equal to 70 mm (this value does not include that part of the small face intended to extend below the nip 6 after it has been fitted). The small base of the trapezium, lying at the rear of the recess, extends over a height "$h_2$" above the level of the nip 6, "$h_2$" being, for example, equal to 55 mm. The recess 16 has a maximum depth "p" equal, for example, to 15 mm. "p" must be greater than the maximum permitted value of the wear of the parts 8, 9, 10 made of hard material of the side wall 4, 4', so that the refractory 17 which fills it can fulfil its function throughout the entire casting run.

Figure 4:
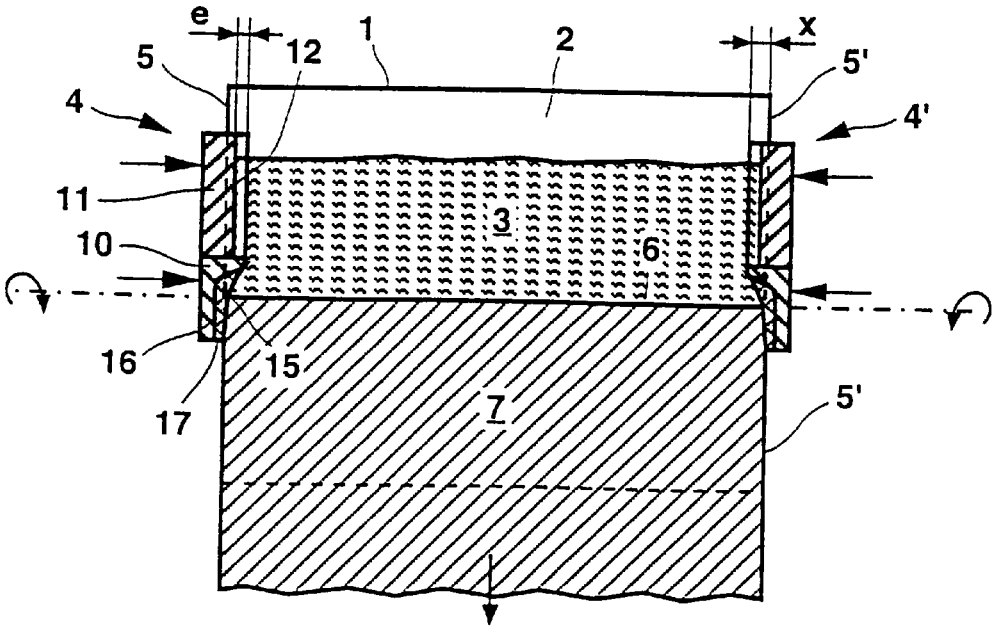
FIG. 4 which shows, seen from the side in longitudinal section, a plant for the twin-roll casting of metal strip equipped with side walls according to the invention, at a stage in the casting run where they have undergone significant wear.

FIG. 4 shows a twin-roll casting plant equipped with side walls 4, 4' according to the invention in operation under the same conditions as the plant illustrated in FIG. 2*b*. In both cases, it may be seen that a positive insert 12, of maximum thickness "x" has been formed at the points where the side walls 4, 4' are made of the hard refractory 10. However, those parts of the side walls 4, 4' according to the invention which are opposite the strip 7 or regions where the metal 3 is in the partially solidified state undergo wear, the quantitative magnitude of which depends on the stresses to which they are subjected. These stresses tend to increase with the solid fraction of the metal 3, and consequently the depth of penetration of the positive insert 12 decreases as the nip 6 is approached. Below the nip 6, or indeed already slightly above it, the positive insert 12 may possibly, as illustrated in FIG. 4, be entirely consumed. As the refractory 17 lining the recess 16 of each side wall 4, 4' according to the invention does not have a very high hardness, its wear is uniform and the presence of fracture lines of tortuous and random shapes, such as the line 13 in FIG. 2*b*, is not normally observed. Moreover, if nevertheless a momentary excessive stress causes the refractory 17 lining the recess 16 to fracture, this fracture would necessarily stop at the boundaries of the recess 16. It would therefore not propagate into the higher parts of the side wall 4, 4', i.e. those which are in contact with entirely liquid metal 3, which would therefore run the risk of escaping from the casting space via anfractuosities which the propagation of this fracture would create. The height "$h_1$", over which the recess 16 and the refractory 17 which lines it extend above the nip 6, must be determined accordingly.

It was mentioned above that materials having a lamellar structure, such as graphite or boron nitride, were particularly indicated for forming the refractory 17 lining the recess 16. This is because this lamellar structure makes them easier to be worn in a uniform and gradual manner, and the change in the shape of the positive insert 12 may thus be controlled better. This said, it may also be quite acceptable to use a material of the type of those normally used for forming the central part 11 of the side walls 4, 4' and which have a relatively low hardness and a high insulating power. The use of these materials also makes it possible to prevent excessively premature solidification of the liquid metal 3 above the nip 6. Finally, it remains within the spirit of the invention to use, for forming the refractory 17 lining the recess 16, a hard refractory of the type which forms the lower part 10 and the edges 8, 9 of the side walls 4, 4'. To be sure, it would then be possible for this refractory 17 to undergo irregular fractures, which could go as far as causing it to be completely destroyed. But at least there would be the assurance that these fractures would stop at the boundaries of the recess 16 and would not reach regions of the side walls 4, 4' where they could cause dangerous leaks of liquid metal 3 from the casting space.

In the example which has just been described and illustrated, the recess 16 has a longitudinal cross section of trapezoidal shape. The intention is thus to ensure that, once the consumption of the refractory 17 has been initiated, the bared hard refractory 10 presents to the liquid or partially solidified metal 3 a bevelled surface offering only a relatively limited possibility of mechanical wear. A rectangular cross section for this recess 16 would leave, after the refractory 17 has been worn away, a hard refractory 10 with a sharp angle making it more sensitive to wear and more subject to sudden and irregular fractures. Having said this, such a rectangular cross section of the recess 16 would essentially remain within the spirit of the invention.

As a variant, the recess 16 may also be provided with a longitudinal cross section in the form of a right-angled triangle.

The invention may easily be adapted to side walls having general shapes which differ from that illustrated in the above example.

The description above was given with reference to the casting of (carbon or stainless) steel strip, but it goes without saying that the invention may be applied to the twin-roll casting of the other types of ferrous and nonferrous alloys where the problems mentioned above would be likely to occur.

What is claimed is:

1. A side wall for closing off a casting space of a plant for the continuous casting of metal strip between two counter-rotating rolls which define a nip area and have horizontal axes, said side wall having an upper edge and a lower edge, comprising a lower wall part made of a high-hardness first refractory in a region where said lower wall part is in contact with end faces of said rolls, or liquid metal in the course of solidifying, or an edge of said solidified strip, wherein said lower wall part has a top edge that is below the upper edge of said side wall and includes, on a face defining part of a casting space, a means for preventing cracking in said side wall in an area adjacent to said nip area including a recess filled with a refractory.

2. The side wall as claimed in claim 1, wherein said refractory enclosed by said recess is a material having a lower hardness than said first refractory and high thermal insulation properties.

3. The side wall as claimed in claim 2, wherein said refractory enclosed by said recess is a material having a lamellar structure.

4. The side wall as claimed in claim 1, wherein said recess has, in a depthwise direction, a longitudinal section in the form of a right-angled trapezium.

5. The side wall as claimed in claim 1, wherein said recess has, in a depthwise direction, a longitudinal section in the form of a right-angled triangle.

6. The side wall claimed in claim 3, wherein said material is one of the group consisting of graphite and boron nitride.

* * * * *